United States Patent [19]

Hennechart et al.

[11] Patent Number: 4,612,215

[45] Date of Patent: Sep. 16, 1986

[54] PROCESS AND INSTALLATION FOR THE CONTINUOUS APPLICATION OF AN OXIDIZABLE COATING TO A STRIP

[75] Inventors: Jean-Paul Hennechart, Mouzon; Bernard Bramaud, Nanterre; Francois Prat, Mouzon, all of France

[73] Assignee: Ziegler S.A., Paris, France

[21] Appl. No.: 738,515

[22] Filed: May 28, 1985

Related U.S. Application Data

[63] Continuation of Ser. No. 597,050, Apr. 5, 1984, abandoned.

[30] Foreign Application Priority Data

Apr. 13, 1983 [FR] France ..... 83 06056

[51] Int. Cl.[4] ..... B05D 1/12

[52] U.S. Cl. ..... 427/19 R; 427/398.4; 427/432; 427/433; 427/434.2; 427/436; 118/61; 118/63; 118/65; 118/69; 118/308; 118/312; 118/419

[58] Field of Search ..... 427/192, 205, 398.4, 427/432, 433, 434.2, 436, 349, 377; 118/61, 63, 65, 69, 308, 312, 419; 423/219

[56] References Cited

U.S. PATENT DOCUMENTS

| | | | |
|---|---|---|---|
| 1,588,258 | 6/1926 | Metzger | 423/219 |
| 1,773,495 | 8/1930 | Newhall et al. . | |
| 2,526,731 | 10/1950 | Coburn | 427/432 X |
| 2,889,803 | 6/1959 | Pearson . | |
| 4,107,357 | 8/1978 | Asakawa et al. | 427/432 X |
| 4,330,574 | 5/1982 | Pierson et al. | 427/432 X |
| 4,369,211 | 1/1983 | Nitto et al. | 427/432 X |
| 4,370,357 | 1/1983 | Swartz | 118/61 X |
| 4,444,814 | 4/1984 | Flinchum | 427/432 X |
| 4,502,408 | 3/1985 | Hennechart et al. | 118/312 |

FOREIGN PATENT DOCUMENTS

| | | |
|---|---|---|
| 0066523 | 12/1982 | European Pat. Off. . |
| 2454470 | 11/1980 | France . |
| 55-110716 | 11/1980 | Japan . |
| 56-158860 | 3/1982 | Japan . |

*Primary Examiner*—Shrive P. Beck

*Attorney, Agent, or Firm*—Burns, Doane, Swecker & Mathis

[57] ABSTRACT

A process and an installation for the continuous application of an oxidizable coating to a strip.

The object of the invention is to provide an improvement in the recycle ratios and a savings of inert replenishing gas in an installation, in the enclosure which protects the draining means for controlling the coating, is recycled. To achieve this result, provision is made for the continuous purification of this gas by bringing it into contact with a reductive substance. If protective enclosure also contains the minimized flouring nozzles, zinc vapor can be introduced into the gas. This zinc vapor reacts with the oxygen and produces the nuclei by condensation.

18 Claims, 5 Drawing Figures

PROCESS AND INSTALLATION FOR THE CONTINUOUS APPLICATION OF AN OXIDIZABLE COATING TO A STRIP

This application is a continuation of application Ser. No. 597,050, filed Apr. 5, 1984, now abandoned.

FIELD OF THE INVENTION

The present invention relates to a process and an installation for the continuous deposition of a coating on a strip, this deposition being carried out by passing the strip through a bath of coating material heated above its melting point. The invention applies in particular to the coating of sheet steel with a layer of a metal such as zinc.

PRIOR ART

For a long time, processes have been known in which a thin strip of metal is first drawn continuously through stations for surface preparation and preheating, and then, by virtue of immersed rollers, passes through a bath of molten coating material, for example zinc, after which it leaves the bath to follow a vertical ascending path. On leaving the bath, it is carrying a layer of liquid coating material whose thickness depends especially on the speed of travel, the temperature of the bath and the surface condition of the strip. This liquid layer solidifies as the strip cools when it emerges from the bath.

To obtain a coating layer of uniform thickness, without impurities and with uniform crystallization, all the factors involved in the operation should be precisely controlled.

In the oldest technique, rollers were used to even out the thickness of the coating layer when it was still liquid. French Pat. No. 1,563,457 describes a more effective method which consists of sending a jet of gas onto this layer of liquid coating material, the gas preferably being air in the case of a lead coating and dry steam in the case of zinc. This jet of gas is produced by a nozzle in the form of a slit, the shape, position and orientation of which are precisely defined, as is the gas pressure. This produces a jet in the form of a sheet, which removes the outer fraction of the thickness of liquid and causes it to fall back into the bath, carrying with it the dross and oxides which may exist on the surface of the bath.

In current practice, the gas most commonly used is air.

Furthermore, to obtain a coating layer with fine and uniform crystallization, a so-called "minimized flouring" process is known in which a gas charged with crystal nuclei is sprayed onto the strip.

This gas is usually compressed air into which fine solid particles of zinc have been introduced. To prevent those particles which do not become attached to the strip from spreading throughout the workshop, a suction mouth is placed in the immediate vicinity of the blast nozzle and the air sucked out is recycled after filtration.

The accelerated cooling under the effect of the gas jet, combined with the presence of a large number of nuclei, leads to fine and uniform crystallization.

On the whole, these methods give satisfactory results; however, user requirements are always increasing in strictness and it has been found that the invariability of the finished product is not absolutely perfect as regards the presence of oxides on the surface and the crystallization of the coating material, especially in the case of thin sheets with a low coating thickness.

It is known (British Patent Application No. A-777,353) to protect the coating from oxidation when it leaves the bath by causing the strip to pass through an enclosure whose walls dip into the bath and whose upper part has a narrow opening through which the strip leaves. An inert gas resides in this enclosure, which also contains rollers for evening out the thickness of the coating.

To improve the quality further, it was proposed (French Patent Application No. A-2,454,470) to use an inert gas of high purity, for example nitrogen having a very low oxygen content. A gas of this type is expensive and provision was made to recycle it, but, despite the precautions taken (circuits as gastight as possible, cooling and filtration), it is difficult to achieve a recycle ratio of more than 0.5.

The high price of nitrogen having a very low oxygen content, and that of other gases of high purity, is one cause of the high cost price.

SUMMARY OF THE INVENTION

The main object of the present invention is to reduce the consumption of inert gas of high purity without excessively increasing the complexity of the installation, so as to acheive overall a substantial lowering of the cost prices.

Another object of the invention is to improve the quality of the product through a better uniformity of crystallization.

The invention thus provides a process for the continuous coating of a strip with an oxidizable coating material, in which process the strip is caused to pass through a bath containing the coating material in the liquid state and the strip is caused to leave this bath in an ascending direction. The strip is then subjected to an operation for equalizing the thickness of the layer of liquid coating material carried by the strip, this equalizing operation being carried out in an enclosure substantially isolated from the atmosphere and containing a first non-oxidizing or weakly oxidizing gas, which is at least partially recycled. The equalizing operation is followed, if appropriate, by a nuclei spraying operation in which a second gas charged with crystal nuclei of the said coating material is sprayed onto the still liquid coating material, this gas then being at least partially recycled. This process has the particular characteristic that at least part of the first gas and/or at least part of the second gas is purified by bringing it into contact with a reductive substance in order to bring its oxygen content below a preselected value.

The known recycling, combined with purification which is carried out during this recycling itself, permits a very precise control of the oxygen content of the gas and a high degree of flexibility in adapting this content to requirements. The quantity of reductive substances needed is small since, under normal operating conditions, it only corresponds to compensation for the oxygen which re-enters and is adjusted accordingly.

Preferably, the operations of equalizing the coating thickness and of blasting nuclei take place in a common enclosure in which the first and second gases mix. In this way, the quality is further improved by virture of the fact that the strip can be protected from the atmosphere up to crystallization. Also, the installation is simplified because of the existence of a single enclosure and, if appropriate, of a single purifying device arranged on one of the recycling circuits or at a point common to both these circuits.

In an preferred embodiment, when the second gas is purified, the purification is carried out simultaneously with the introduction of crystal nuclei into the second gas before it is used for spraying nuclei.

In this case, if the substance which produces the crystal nuclei is reducing, it is advantgeous to make provisions for introducing the reducing substance into the second gas, which is then brought to a sufficiently high temperature to lower its oxygen content to the selected value by reaction of the oxygen with the reducing substance.

This reduction reaction can be improved by injecting into the second gas a small quantity of a hydrocarbon, in which case the substance which produces the nuclei, for example zinc, acts as a catalyst in the hydrocarbon/oxygen reaction in addition to its actual reducing function.

The second gas, which contains the oxidation product of the reducing substance and, if appropriate, part of the substance which has not reacted, is then brought to the appropriate temperature condition for the nuclei spraying operation. Preferably, the reducing substance is introduced into the second gas in the vapor state and, after the oxidation of part of this vapor, the second gas is cooled in order to induce the substance to form nuclei by condensation to the solid state.

Combining the introduction of nuclei with the purification permits a simplification of the installation and hence a reduction in investment.

Introduction of the reducing substance in the vapor state leads to a further improvement in the quality by virtue of a better dispersion of this substance in the second gas. Hence, a better invariability of the oxygen content and of the content of crystal nuclei is achieved.

In another preferred embodiment, which can be combined with the previous embodiment or replace it, the gas to be purified is brought into contact with a hot surface in the presence of the reducing substance. The latter is advantageously a hydrocarbon (for example methane) which is introduced in small quantities. This hot surface can consist of plates heated by any appropriate means, but can also consist of the actual sheet leaving the bath, in the case where the metal coating bath is at a sufficiently high temperature (for example in the manufacture of aluminized sheet metal). This embodiment is particularly suitable in the case where it is desirable either to use the minimized flouring equipment or, alternatively, to leave it inoperative. In fact, this embodiment can be put into effect either with the first gas or with the second gas where the crystal nuceli being introduced into the latter in a conventional manner. It can also be put into effect inside the enclosure common to both circuits, if such an enclosure exists.

For carrying out the process which has just been explained, the invention also provides an installation comprising means for successively causing a strip to pass continuously through a molten bath of coating material and causing this strip to leave the bath in an ascending direction, means for equalizing the thickness of the layer of liquid coating material carried by the strip, where these means may include at least one draining nozzle arranged so as to blast a jet of gas in the form of a sheet in the direction of the strip, where these means are arranged inside an enclosure open towards the bottom and having side walls which dip into the bath and an upper wall having a narrow slit through which the strip can leave. This enclosure is associated with a circuit for recycling the gas which it contains and for sending this gas to the draining nozzle or nozzles. The installation also comprises at least one blast nozzle for cooling the strip below the solidification point of the coating material and, if appropriate, for spraying crystal nuclei onto it, whereby this blast nozzle is associated with a circuit for recycling the second gas and includes means for introducing crystal nuclei into the second gas upstream of the blast nozzle or nozzles. This installation also comprising means for introducing a reducing substance into the circuit for recycling the gas in the enclosure and/or into the circuit for recycling the second gas, and means for bringing the corresponding gas to a temperature at which the reducing substance reacts with the oxygen contained in the gas in order to bring its concentration below the selected value.

Preferably, the means for equalizing the coating thickness and the nozzle or nozzles for blasting nuclei are arranged in a common enclosure, and preferably the means for introducing the reducing substance or substances and for bringing the gas to the reaction temperature are arranged either in the enclosure or in only one of the recycling circuits.

In another preferred embodiment, the means for introducing the reducing substance into the gas and for bringing this gas to the reaction temperature consists of an enclosure through which the gas passes and which contains a bath of reducing substance in the liquid state and a plasma torch, arranged above this bath, for vaporizing the reducing substance. The purification reaction can be improved by the addition of a small quantity of hydrocarbon.

In another embodiment of the installation, the means for introducing the reducing substance into the gas consists of an enclosure containing a bath of reducing substance in the liquid state, and means for forcing the gas either to sweep the surface of this bath or to bubble through it. The quantity of reducing substance introduced into the gas is a function of the temperature of the metal bath of the reducing substances and/or of the flow rate of gas bubbling into this enclosure. As in the previous embodiment, the purification reaction can be improved by the injection of a small quantity of a hydrocarbon.

Preferably, with any of the embodiments which have just been mentioned, the means for introducing the reducing substance into the gas is arranged on the circuit for recycling the second gas, and, between the means and the nozzle or nozzles for blasting nuclei, a provision is made for means for cooling the second gas down to the formation of nuclei by condensing the reducing substance to the solid state.

In another preferred embodiment, the means for deoxygenating the gas is obtained by arranging plates, which are heated to a high temperature, in the enclosure in the immediate vicinity of the narrow slit provided in the upper wall of the enclosure, and by introducing a small quantity of hydrocarbon into the enclosure, in the vicinity of these plates in order to deoxygenate the gases contained in the enclosure. This device can be installed at a point in either of the circuits, but the arrangement which has just been described gives better control of the oxygen content. In fact, the exit slit for the strip is also the main passage for the entry of oxygen into the enclosure via circulation in a direction countercurrent to the movement of the strip.

BRIEF DESCRIPTION OF THE DRAWINGS

The invention will now be explained in greater detail with the aid of the figures; in these figures.

DETAILED DESCRIPTION

Figure 1:
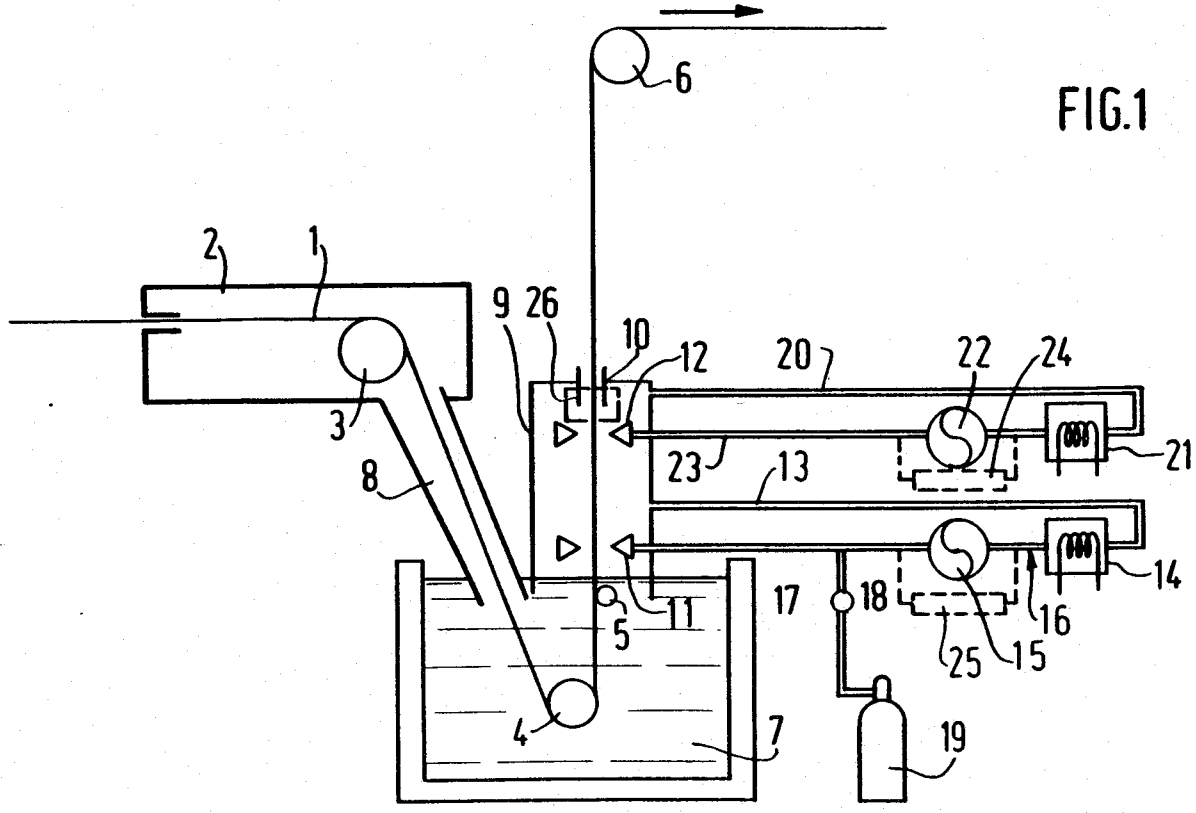
FIG. 1 is a simplified view of the installation in vertical section.

A strip 1 to be coated arrives at the left of FIG. 1; it first passes through a furnace 2 with a controlled reducing atmosphere, which, at one and the same time, cleans and prepares the surface, effects a heat treatment, if appropriate, and adjusts the temperature of the sheet to a temperature similar to that of the bath.

The strip 1, guided by rollers 3, 4, 5, subsequently descends through the molten zinc bath 7 and then returns vertically above the bath and is sent, after a roller 6, to a winding station (not shown). A sheath 8, which dips into the bath and communicates with the furnace 2, surrounds the strip along its path between the furnace and the bath 7 so as to prevent the formation of any oxide on the hot cleaned metal before it comes into contact with the zinc in the bath.

On leaving the bath, the strip is surrounded by a bottomless vessel 9 whose side walls dip into the molten zinc. The roof of the vessel has a very narrow slit 10 through which the strip 1 leaves in the upward direction.

Arranged inside the vessel, there are two draining nozzles 11, in the form of elongated slits, for keeping the thickness of the coating at the desired value, and, above these nozzles are 11, two other nozzles 12 for cooling and/or minimized flouring.

The draining nozzles 11 are fed with nitrogen from a recycling circuit comprising an extraction pipe 13 through which gas is extracted from the vessel 9, and a cold-water cooler 14 which lowers the temperature of the gas in order to improve the operation of a downstream pump 15. A filter 16 is inserted between the cooler and the pump. A feed pipe 17 joins the pump 15 to the draining nozzles 11. Connected to the feed pipe 17 is a nitrogen replenishing pipe 18 fitted with a valve and joined to a source of very pure nitrogen, 19.

The minimized flouring nozzles are fed by an analogous circuit comprising an extraction pipe 20, a cooler 21, a pump 22 and a feed pipe 23, but without a replenishing pipe.

Three possible positions of a purifying device have been shown in broken lines:

24 shows the purifying device connected to the minimized flouring gas circuit, and which is then combined with the device for supplying crystal nuclei.

25 shows the purifying device connected to the draining gas circuit; in this case, it can consist of means for injecting a gaseous or liquid hydrocarbon, or an analogous substance, and a hot surface which the gas strikes.

26 shows the purifying device placed in the vessel 9, in the vicinity of the slit 10. This device can comprise one or more hot surfaces and the means for injecting hydrocarbon can be placed at another point in the circuits.

Figure 2:
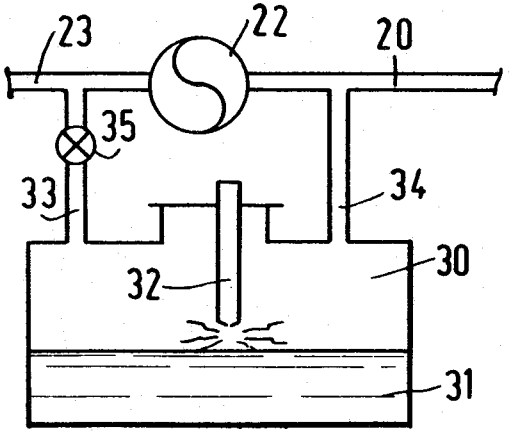
FIG. 2 is a simplified partial view in vertical section of an apparatus for introducing the reducing substance into the gas.

FIG. 2 shows an apparatus for introducing reducing substance, which is preferably placed at the location denoted by 24 in FIG. 1.

This apparatus comprises a closed enclosure 30 which contains a liquid zinc bath 31 and, above this bath, a plasma torch 32 arranged so as to vaporize the zinc in the bath. The enclosure 30 is joined to the pipes 20, 23 by two pipes 33, 34, on either side of the pump 22, so as to form a circuit parallel to the circuit comprising the nozzles 12 for spraying nuclei. A regulating valve 35 is provided on the pipe 33 through which gas enters the enclosure.

Figure 3:
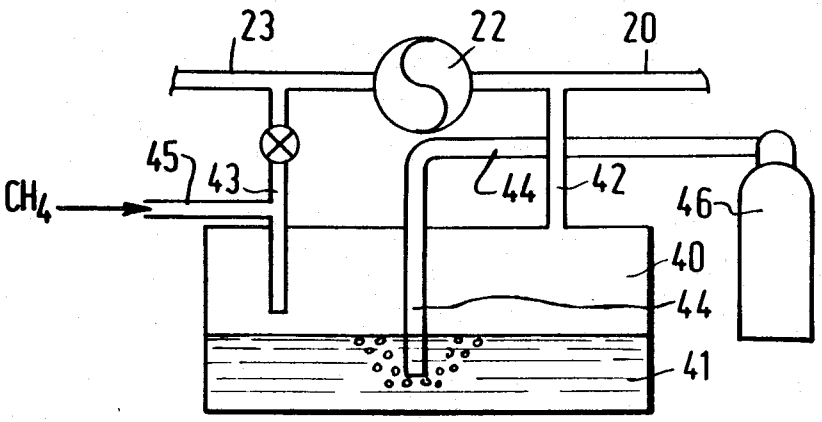
FIG 3. is a view, similar to FIG. 2, of another apparatus for introducing the reducing substance into the gas.

FIG. 3 shows another apparatus for introducing reducing substance, which can replace the apparatus in FIG. 2. It comprises an enclosure 40 in which a liquid zinc bath 41 is kept at a temperature selected so as to introduce the desired quantity of zinc vapor into the gas. The free surface of the bath 41 is consequently also defined. The gas inlet pipe 43 and outlet pipe 42 are arranged in the same manner as in the case of FIG. 2. If it is desired to increase the quantity of zinc vapor introduced into the gas, it is also possible to make a provision for bubbling a small quantity of gas through a tube 44 immersed in the bath, this tube being joined to a source of very pure nitrogen, 46. Furthermore, a tube 45, joined to the pipe 43, makes it possible to introduce a very small quantity of hydrocarbon; in the presence of zinc powder, the latter improves the deoxygenation of the gas which is recycled.

For both of these apparatuses, the formation of nuclei, i.e. zinc particles, takes place mainly in the pipe 23 where the gas cools, naturally or in a forced manner, before reaching the nozzles 12.

Figure 5:
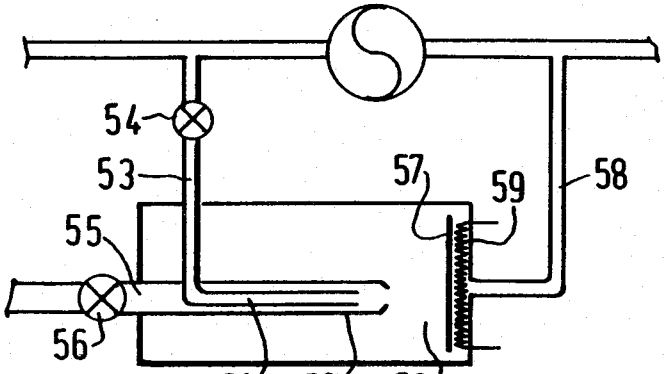
FIG. 5 is a simplified view of an apparatus operating according to the same principle as that in FIG. 4, but placed in a recycling circuit.

FIG. 5 shows another embodiment of the purifying apparatus. Arranged in an enclosure 50 are two concentric nozzles 51, 52, the first of which is supplied with gas to be purified through an inlet pipe 52 provided with a valve 54, and the second of which is supplied with methane, or another hydrocarbon, through a feed pipe 55 provided with a valve 56. The mixture of gas to be purified and methane is sprayed towards a plate 57 heated, for example by heating elements, to a sufficient temperature for the free oxygen to disappear. The purified gas is recycled through a return pipe 58. An apparatus of this type can be arranged either the position identified by 24 in or in the position identified by 25 in FIG. 1. If it occupies the position 24, a conventional device for introducing nuclei must be provided.

Figure 4:
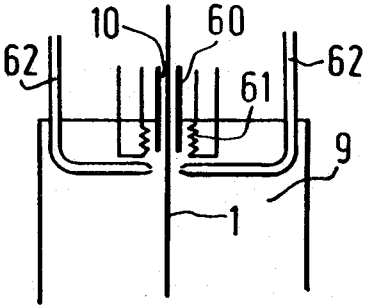
FIG. 4 is a simplified view of the apparatus permitting the hydrocarbon/oxygen reaction, with heated plates arranged at the outlet of the enclosure.

In the variant shown in FIG. 4, two plates 60 are arranged on either side of the slit 10 through which the strip 1 leaves the enclosure 9, and which corresponds to the position 26 in FIG. 1. These plates 60 are heated by heating elements 61 to a temperature such that the oxygen penetrating through the slit 10 in counter-current to the strip 1 reacts immediately with the methane introduced into the gas in the vicinity of the hot surfaces.

This more effective arrangement can only be recommended if the methane contents are low enough not to cause explosion hazards.

Given below are data relating to operations which have been carried out in the installation which has just been described, with a 1 m wide strip travelling at 35 meters/minute: for a coating thickness corresponding to 100 g/m$^2$ on each face, the flow rate of nitrogen blasted at the nozzles was 2800 Nm$^3$/hour under an excess pressure of 0.1 bar at the inlet of the nozzles, and the pressure in the vessel was approximately in equilibrium with atmospheric pressure. The temperature of the atmosphere in the vessel 9 was 150° C., the temperature of the strip in the region of the slit 10 was 430° C. and the solidification temperature was 420° C.

In a first operation, the zinc vaporizing device and the methane injecting means were inoperative. For an additional quantity of nitrogen injected at 200 m$^3$/hour into the recycling circuit, the oxygen content of the nitrogen in circulation was 2%.

In a second operation, the zinc vaporizing device described in FIG. 2 was operative, the temperature of the zinc in the bath 31 was 460°-500° C. and the operating characteristics of the plasma torch were as follows:

voltage: 100 V
current intensity: 70 to 100 A
argon: 45 liters/minute
hydrogen: 10 liters/minute
temperature of the strip on leaving the slit 10: 380° C.

The oxygen content of the nitrogen in circulation was less than 200 ppm.

In another experiment, the device in FIG. 3 was used, the other conditions being the same. The temperature of the zinc in the bath was 600° C., the flow rate of nitrogen sweeping the surface of this crucible was 25 m$^3$/hour, the flow rate of nitrogen bubbling through the crucible was 2 m$^3$/hour and the quantity of methane injected was 1 m$^3$/hour.

This again gave an oxygen content of the nitrogen of less than 200 ppm.

In a fourth experiment, using the device in FIG. 4, the flow rate of injected methane was 2 m$^3$/hour and the temperature of the hot surface 60 was 700° C. This gave an oxygen content of the nitrogen of 10 to 20 ppm.

The device in FIG. 4 thus makes it possible to obtain very high degrees of purity with respect to oxygen, but it must be noted that it does not provide nuclei for the minimized flouring nozzles. If this operation is necessary, a separate feed for these nuclei must be provided. For example, a zinc vaporizing device according to FIG. 2 or 3 can be operated in parallel.

What is claimed is:

1. A process for the continuous coating of a strip with an oxidizable coating material comprising the steps of: causing the strip to enter and pass through a bath containing the coating material in the liquid state, causing the strip to leave the bath in an ascending direction, equalizing the liquid coating material thickness carried by the strip, said equalizing operation being carried out in an enclosure substantially isolated from an atmosphere external to said enclosure and containing a first non-oxidizing or weakly oxidizing gas, said first gas being at least partially recycled and purified by bringing the gas into contact with a reducing substance to bring its oxygen content below a preselected value, the gas to be purified being reacted with a reducing substance of the hydrocarbon type, introduced in a small quantity, on a hot surface comprising a heated plate or a coated sheet.

2. The process according to claim 1, wherein said process includes spraying in said enclosure a second gas charged with crystal nuclei onto the liquid coating material.

3. The process as claimed in claim 2, wherein the operations of equalizing the coating thickness and of spraying nuclei take place in a common enclosure in which the first and second gases are in contact.

4. The process as claimed in claim 2 in which the second gas is purified, wherein the purification is carried out simultaneously with the introduction of crystal nuclei into the second gas before said second gas is used for spraying nuclei.

5. The process as claimed in claim 2 in which the substance which produced the crystal nuclei is reductive, wherein the substance is introduced into the second gas and the second gas is brought to a sufficiently high temperature to lower its oxygen content to a selected value by reaction of the oxygen with the substance, and the second gas is brought to the appropriate temperature conditions for the nuclei spraying operation.

6. The process as claimed in claim 2, wherein the substance is introduced into the second gas in the vapor state, and wherein, after the oxidation of part of said vapor, the second gas is cooled to induce the substance to form the nuclei by condensation to the solid state.

7. The process as claimed in claim 2, wherein a small quantity of hydrocarbon is also introduced into the second gas to improve the operation of purifying the second gas by reduction of the oxygen, the substance which produces the nuclei acting as a catalyst in the reaction of the hydrocarbon with the oxygen, in addition to the actual reducing function of the substance which produces nuclei.

8. The process as claimed in claim 2, wherein the substance which produces the nuclei is zinc.

9. The process as claimed in claim 2, wherein both the first recycled gas and the second recycled gas are purified by bringing the gases into contact with a reducing substance to bring their oxygen contents below the preselected value.

10. The process as claimed in claim 1, wherein the coating material is zinc, a zinc alloy, aluminum, or an aluminum alloy.

11. The installation as claimed in claim 1, wherein the means for introducing the reducing substance into the gas consists of an enclosure containing a bath of reducing substance in the liquid state, and means for forcing the gas to sweep the surface of the bath.

12. An installation comprising means for successively causing a strip to enter and pass continuously through a molten bath of coating material and causing said strip to leave the bath in an ascending direction; means for equalizing the thickness of the layer of liquid coating material carried by the strip, said equalizing means being arranged inside an enclosure open towards the bottom and having side walls which dip into the bath and having an upper wall provided with a narrow slit through which the strip can leave, said enclosure being associated with a gas circuit having means for recycling a first gas from said enclosure; at least one blast nozzle for cooling the strip below a solidification point of the coating material; means for introducing a reducing substance into said circuit for recycling said first gas; and means for bringing said first gas to a temperature at which the reducing substance reacts with the oxygen contained in the gas to bring its concentration below a selected value, the means for introducing the reducing substance into the gas and bringing the latter to the reaction temperature consists of an enclosure through which the gas passes and which contains a bath of reducing substance in the liquid state and a plasma torch, arranged about this bath, for vaporizing the substance.

13. An installation according to claim 12, wherein means for spraying a second gas charged with crystal nuclei onto the liquid coating material are contained inside said enclosure.

14. The installation as claimed in claim 13, wherein the means for introducing the reducing substance into the gas is arranged on the circuit for recycling the second gas, and wherein, between the means and the at least one blast nozzle provision is made for means for cooling the second gas down to the formation of nuclei by condensation of the reducing substance to the solid state.

15. The installation as claimed in claim 12, wherein the means for equalizing the coating thickness and the at least one blast nozzle is arranged in a common enclosure, and wherein the means for introducing the reducing substance and for bringing the gas to the reaction temperature are arranged either in the enclosure or in only one of the recycling circuits.

16. The installation as claimed in claim 12, which also comprises means for introducing a hydrocarbon into the gas.

17. The installation as claimed in claim 12, wherein the means for bringing the gas to a temperature at which the reducing substance of the hydrocarbon type reacts with the oxygen contained in the gas comprises a hot wall, and wherein the means is arranged in the enclosure in the vicinity of the narrow slit provided in the upper wall of the enclosure.

18. The installation as claimed in claim 12, wherein the means for introducing the reducing substance into the gas also consists of means for forcing the gas to bubble through the bath.

* * * * *